US008132674B1

(12) United States Patent
Allore et al.

(10) Patent No.: US 8,132,674 B1
(45) Date of Patent: Mar. 13, 2012

(54) CONTINUOUS CLEANING TRAMP METAL SEPARATION DEVICE

(75) Inventors: Dan Allore, Harbor Springs, MI (US); John Godzik, Petoskey, MI (US)

(73) Assignee: Industrial Magnetics, Inc., Boyne City, MI (US)

( * ) Notice: Subject to any disclaimer, the term of this patent is extended or adjusted under 35 U.S.C. 154(b) by 56 days.

(21) Appl. No.: 12/760,991

(22) Filed: Apr. 15, 2010

Related U.S. Application Data

(60) Provisional application No. 61/171,490, filed on Apr. 22, 2009.

(51) Int. Cl.
*B03C 1/00* (2006.01)

(52) U.S. Cl. ..... 209/223.1; 209/228; 209/229; 209/232

(58) Field of Classification Search ..... 209/223.1, 209/223.2, 228, 229, 231
See application file for complete search history.

(56) References Cited

U.S. PATENT DOCUMENTS 4,620,923 A 11/1986 Meister
4,867,869 A * 9/1989 Barrett ..... 209/223.2
5,066,390 A * 11/1991 Rhodes et al. ..... 209/217
5,188,239 A * 2/1993 Stowe ..... 209/223.1
5,316,151 A * 5/1994 Thompson ..... 209/223.1
5,557,186 A * 9/1996 McMurtrey et al. ..... 318/626
6,250,475 B1 * 6/2001 Kwasniewicz et al. ..... 209/229
6,902,066 B2 * 6/2005 Yang ..... 209/223.1
7,841,475 B2 * 11/2010 Ricardo et al. ..... 209/229

* cited by examiner

*Primary Examiner* — Terrell Matthews
(74) *Attorney, Agent, or Firm* — Young Basile P.C.

(57) ABSTRACT

A tramp metal separation device includes a first housing having an inlet and an outlet, a first drawer and a second drawer. The first drawer and the second drawer each have a plurality of magnets and a wiper assembly, where each drawer is supported with respect to the first housing such that each first drawer is moveable between an extended position and a retracted position. In the extended position, the magnets of the respective drawer are positioned within the first housing and are adapted to be in contact with the stream of raw materials. In the retracted position, the magnets of the respective drawer are positioned outside of the first housing. The wiper assembly of each drawer removes contaminants from the magnets as the respective drawer moves from the extended position to the retracted position. Each of the first drawer and the second drawer is restrained against movement from the extended position to the retracted position when the other of the first drawer and the second drawer is disposed in the retracted position.

18 Claims, 7 Drawing Sheets

CONTINUOUS CLEANING TRAMP METAL SEPARATION DEVICE

CROSS-REFERENCE TO RELATED APPLICATIONS

This application claims the benefit of U.S. Provisional Patent Application Ser. No. 61/171,490, filed Apr. 22, 2009.

FIELD OF THE INVENTION

The invention pertains to devices for separating unwanted ferrous metals from particulate materials utilizing magnets, and in particular, for separation devices having movable magnets selectively positionable within a stream of such particulate material in such a fashion as to ensure continuous metal separation while allowing the magnets to be selectively cleaned of any accumulation of metal.

BACKGROUND OF THE INVENTION

There are many devices which store or further process a supply of granular material in an industrial environment. Many devices, such as grain storage apparatus or pharmaceutical handling apparatus, are designed to simply direct a supply of granular material to containers for storage. Other devices, such as a variety of industrial fabricating devices, process the material to form a component therefrom. For example, a plastic injection molding machine typically accepts a supply of pelletized plastic material, melts the pellets, injects the resulting liquid plastic into a mold, and discharges a molded part after the part has formed and cooled.

The prior art with respect to devices which handle granular materials is best described by continuing the example with respect to a product-forming machine. In the past, it has been common to use an overhead hopper for feeding the granular pellets of raw material to the product-forming machines. A quantity of pellets is placed in a very large container, such as a self-contained feed hopper, positioned above and adjacent to the machine. This arrangement permits the pellets to be gravity fed continuously into the molding machine.

In this arrangement, all of the raw material in the overhead storage container is directed to the molding machine. Frequently, the supply of raw material includes unwanted microscopic foreign metal material or foreign metal bodies, in the form of metal fragments, screws, washers, or the like. Such unwanted metallic foreign contaminants are referred to as "tramp metals" in the industry. These contaminants may be found in the plastic materials as it comes from the manufacturer due to wear or flaws in the manufacturer's transportation, manufacturing, packaging or conveying machinery. Other metal contaminants may be introduced into the raw materials from operations associated with handling the material at the end manufacturing facility itself. In addition, the growing use of recycled plastic materials for molding purposes increases the frequency of contaminant occurrences in the raw material supplies. The process of reclaiming the recyclable plastics often results in unwanted metallic contaminants becoming intermixed with the recovered plastics as a result of poor separation techniques at material recycling facilities. Frequently, recycling houses process recyclable plastics by chopping them into pieces of suitable size for reuse in molding apparatus. These plastic pieces may contain minute metal contaminants, as well as imbedded metal brackets, screws, nuts, and so on.

The presence of these metallic contaminants in the raw materials being processed in product-forming machines is undesirable for a variety of reasons. Contaminants may actually damage an industrial machine or render the finished part unusable. Even if the part is properly formed, the customer may object to the presence of metal therein as it may cause unacceptable structural, visual, or magnetic aberrations in the finished part.

Magnetic separators have been installed at the feed side of such industrial processing equipment to ensure that metallic contaminants are removed. A magnetic separator typically comprises a housing component which acts as an intermediate hopper adapted to be placed above the forming machinery for the infeed of raw materials. A plurality of magnets form a magnetic drawer adapted to be removably inserted and secured in place in the feed path of this housing. As the granular material feeds through the housing, the metallic particles are attracted to the magnets. Periodically, the drawer is removed and the metallic materials are physically cleared from the magnets. The drawer is then reinserted into the housing for additional service.

A typical device found in the prior art is found in U.S. Pat. No. 5,188,239, issued to Michael Stowe, as shown in FIG. 1. This separator system 10 utilizes a plurality of magnetic tubes 12 secured to a drawer plate 14, with the plurality of magnetic tubes 12 then being inserted into a drawer frame 16 having an outer face plate 18 which defines a plurality of openings 20. Each of the openings is provided with a casket or "wiper," such as an o-ring, and the drawer plate 14 is configured to be movable in relation to the outer face plate 18 of the drawer frame 16, thereby allowing particulate material which has been attracted to the surface of the magnetic tubes 12 to be wiped away for cleaning purposes. During use, the magnetic tubes 12, the drawer plate 14, and the drawer frame 16 are installed as a unit within a housing 22, through a side opening 24, and raw materials are passed through the housing to remove magnetic materials using the magnetic tubes 12. The magnetic tubes 12, the drawer plate 14, and the drawer frame 16 are removed as a unit for cleaning purposes at a cleaning location.

While the prior art mechanisms have been very effective in providing reliable tramp metal separation, they suffer from some drawbacks. First, during the cleaning process, the magnetic drawer assembly must be removed from a housing into which the granular product flows. To ensure that no contaminates remain in the product stream during this process, it is essential that the product flow be interrupted during the cleaning process.

Further, removal of the drawer assembly from the housing leaves an opening in the housing through which any flow of particulate material could result in spillage of material or the ejection of dust associated with the material into the industrial environment.

It is preferable, therefore, to configure a cleaning mechanism which ensures that the magnetic separation operation continues while the magnet assemblies are being cleaned. It is also important that the cleaning operation does not require that the housing in which the magnetic separators are positioned remains closed or sealed during the cleaning operation. The present invention addresses both of these problems.

SUMMARY OF THE INVENTION

A tramp metal separation device for removing contaminants from a stream of raw materials is taught herein. The tramp metal separation device includes a first housing having an inlet and an outlet, a first drawer and a second drawer. The first drawer and the second drawer each have a plurality of magnets and a wiper assembly, where each drawer is supported with respect to the first housing such that each first drawer is moveable between an extended position and a retracted position. In the extended position, the magnets of the respective drawer are positioned within the first housing and are adapted to be in contact with the stream of raw materials. In the retracted position, the magnets of the respective drawer are positioned outside of the first housing. The wiper assembly of each drawer removes contaminants from the magnets as the respective drawer moves from the extended position to the retracted position. Each of the first drawer and the second drawer is restrained against movement from the extended position to the retracted position when the other of the first drawer and the second drawer is disposed in the retracted position.

The tramp metal separation device may include a second housing that is connected to the first housing. The second housing has a substantially enclosed interior and an outlet for removing contaminants from the second housing. The magnets of the first drawer and the second drawer are positioned within the second housing when the first drawer and the second drawer are in their respective retracted positions.

The tramp metal separation device may include a controller operable to control movement of each of the first drawer and the second drawer, wherein the controller is operable to prevent simultaneous disposition of both of the first drawer and the second drawer to the retracted position. In addition, actuators may be provided for moving the first and second drawers. In particular, a first actuator may be operatively connected to the first drawer and electrically connected to the controller for moving the first drawer between its extended position and its retracted position in response to signals from the controller. Similarly, a second actuator may be operatively connected to the second drawer and electrically connected to the controller for moving the second drawer between its extended position and its retracted position in response to signals from the controller.

The wiper assembly of each of the first drawer and the second drawer may have a wiper plate to remove contaminants from each of the first drawer and the second drawer, respectively, wherein each wiper plate is spaced with respect to a peripheral wall of the second housing and is disposed within the second housing when the respective one of the first drawer or the second drawer is positioned in the retracted position.

The first drawer and the second drawer of the tramp metal separation device may be arranged in a vertically-spaced configuration with respect to one another.

The wiper assembly of each of the first drawer and the second drawer may have a plurality of bores formed therethrough, each bore having a respective magnet extending therethrough, wherein each bore has a wiper element disposed therein for removing contaminants from the magnets. Each wiper element may be an o-ring.

DESCRIPTION OF THE PREFERRED EMBODIMENT

Figure 1:
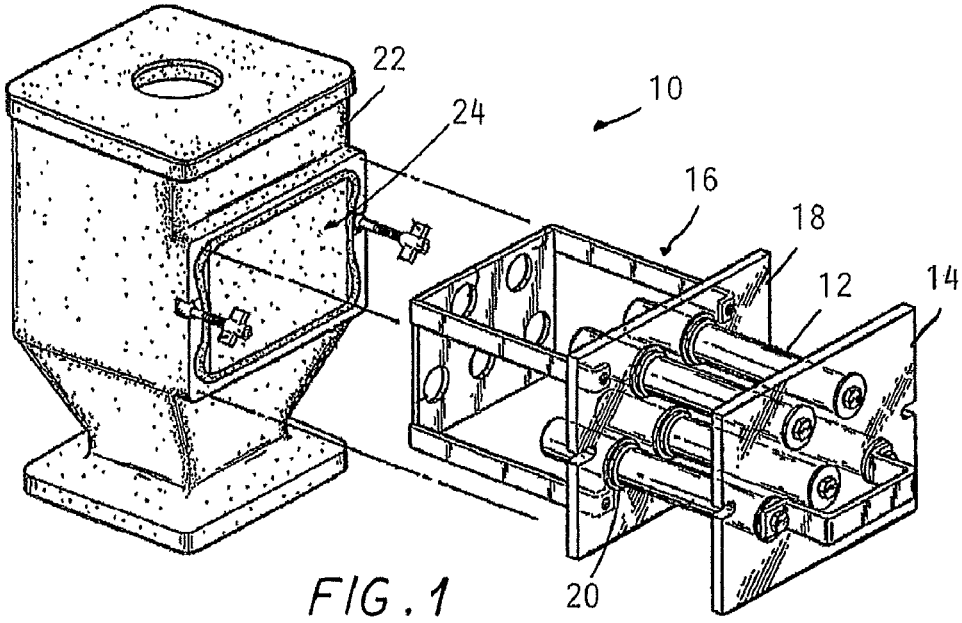
FIG. 1 PRIOR ART
FIG. 1 is a perspective view showing a prior art-type device.
Figure 2:
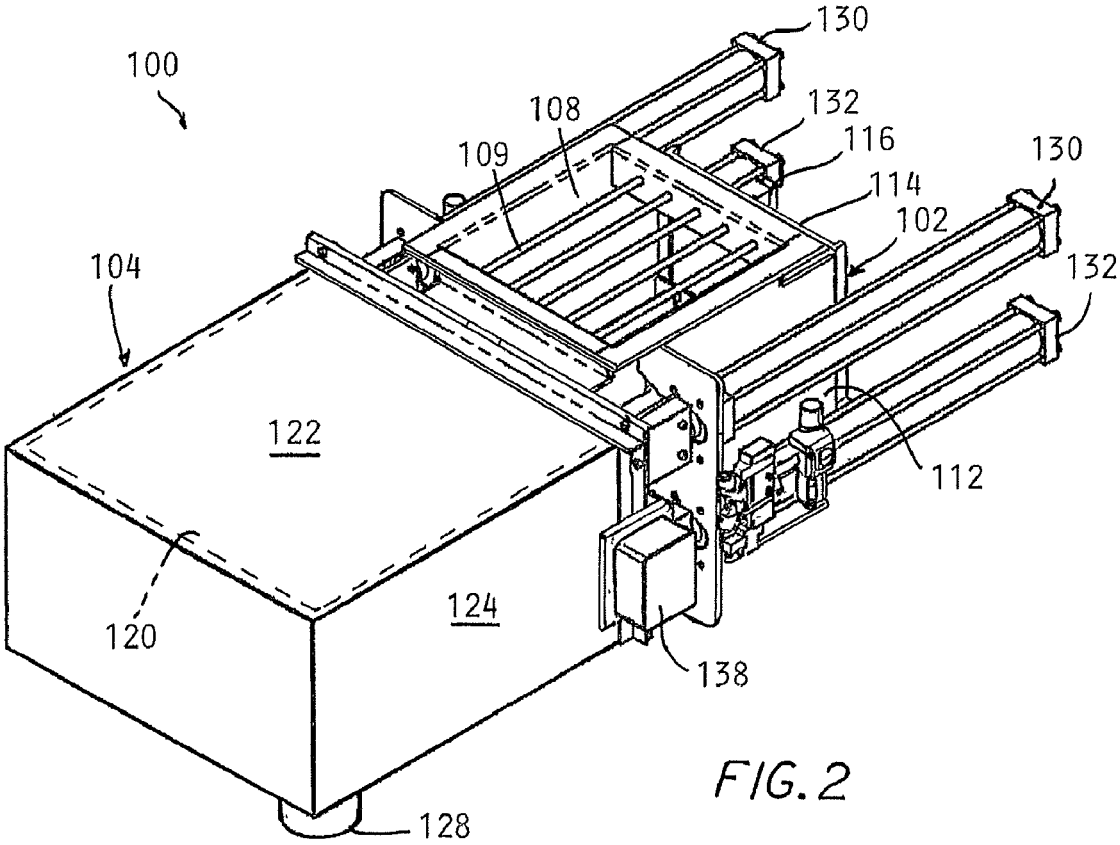
FIG. 2 is a perspective view showing a tramp metal separation device according to the invention.
Figure 3:
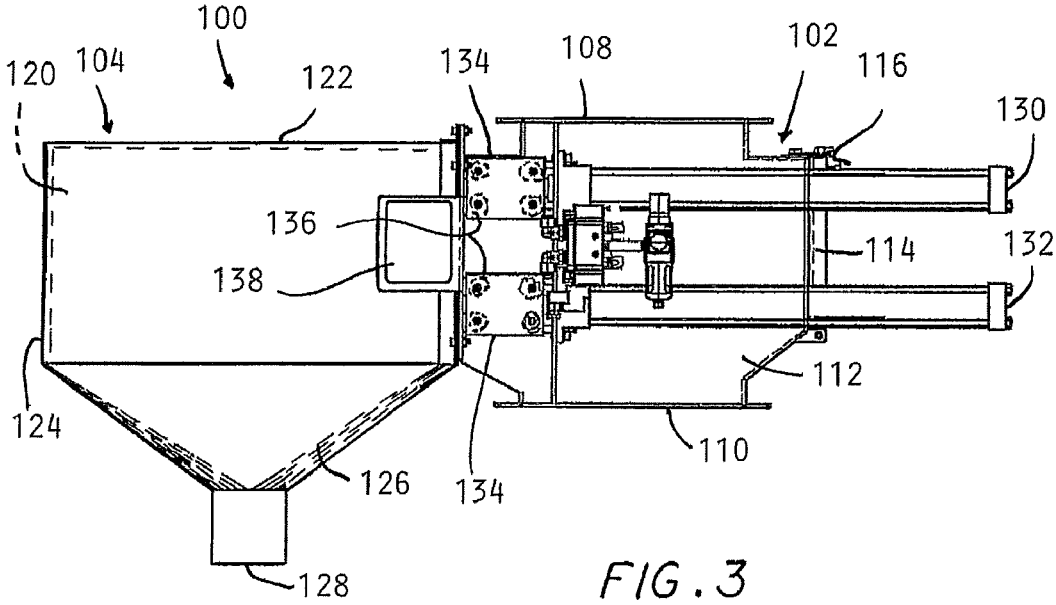
FIG. 3 is a side view showing the tramp metal separation device.
Figure 4:
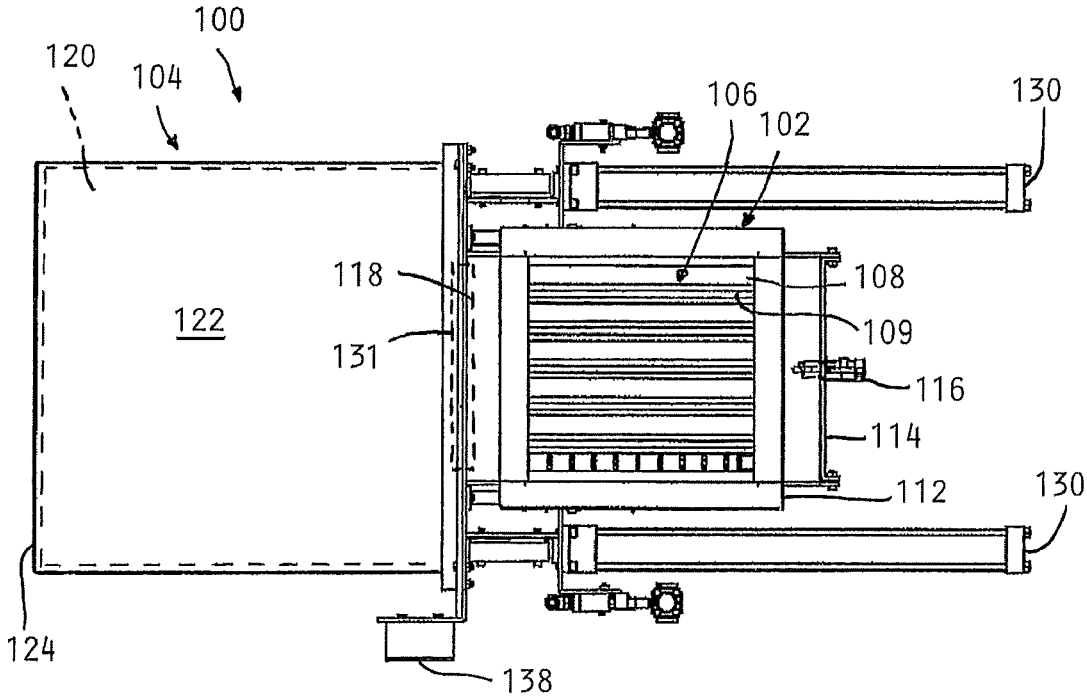
FIG. 4 is a top view showing the tramp metal separation device.
Figure 5:
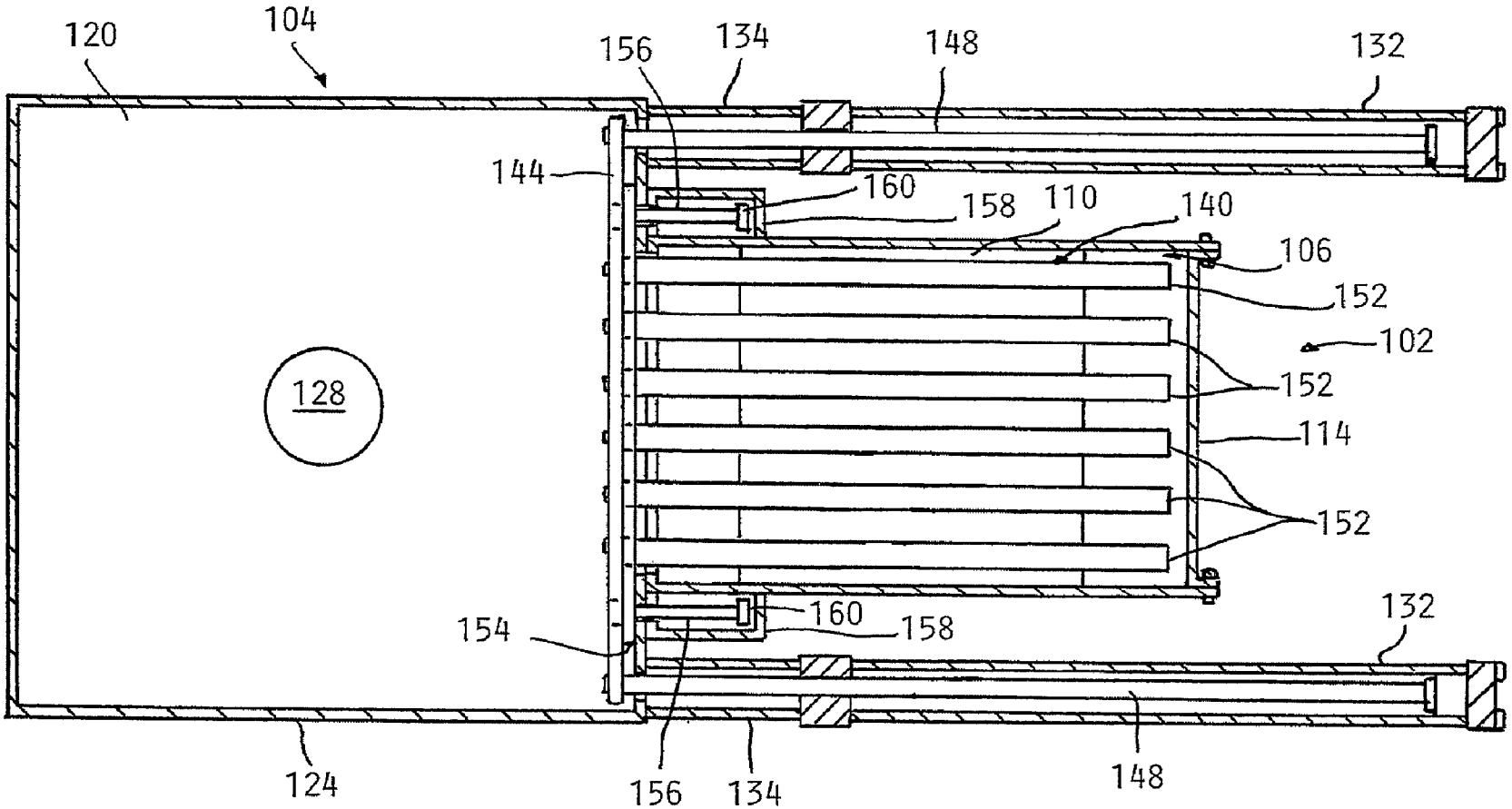
FIG. 5 is a top, cutaway view of the tramp metal separation device showing an upper drawer of a magnet assembly in an extended position.
Figure 6:
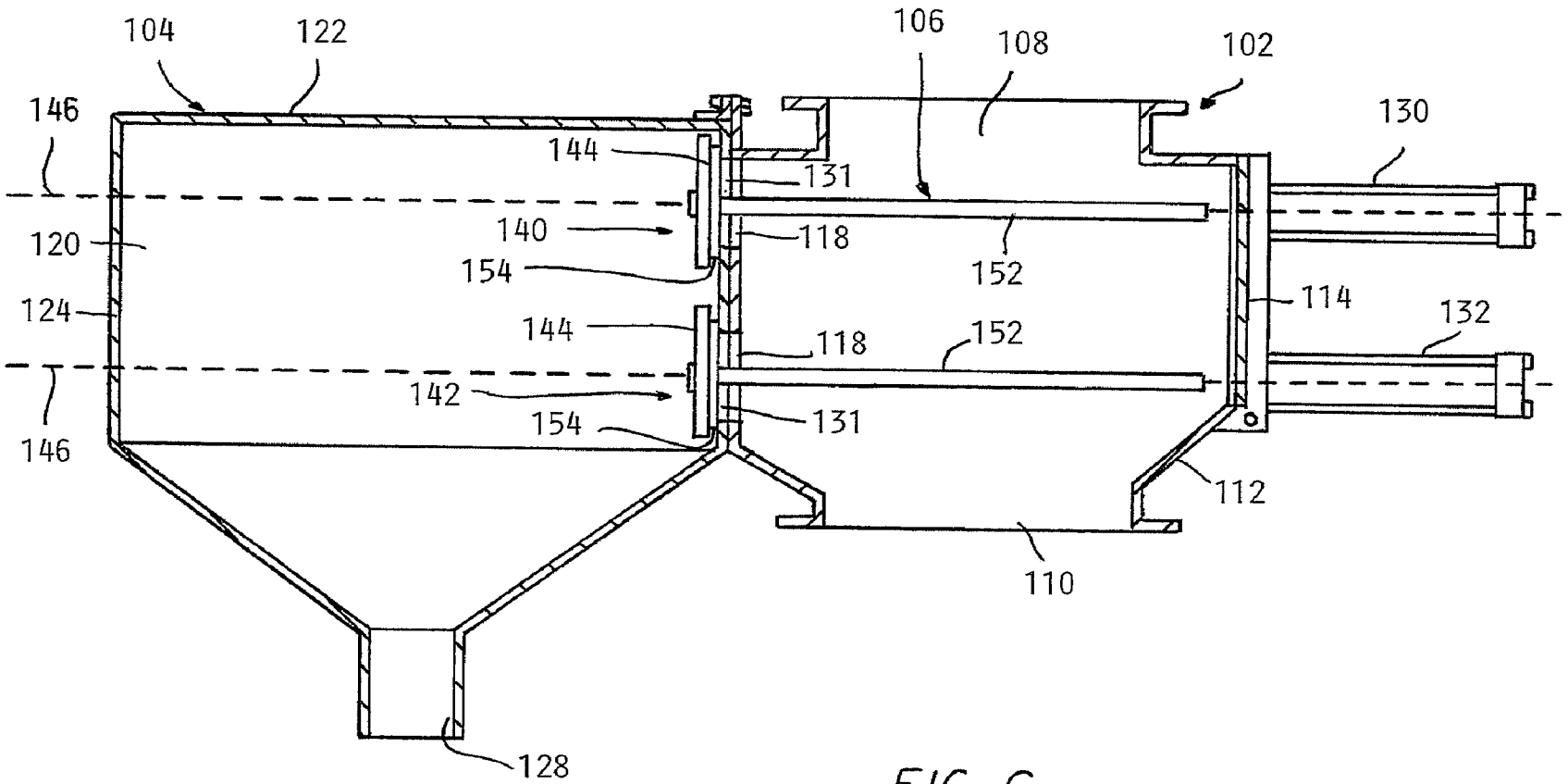
FIG. 6 is a side, cutaway view of the tramp metal separation device showing the upper drawer of the magnet assembly in the extended position and a lower drawer of a magnet assembly in an extended position.
Figure 7:
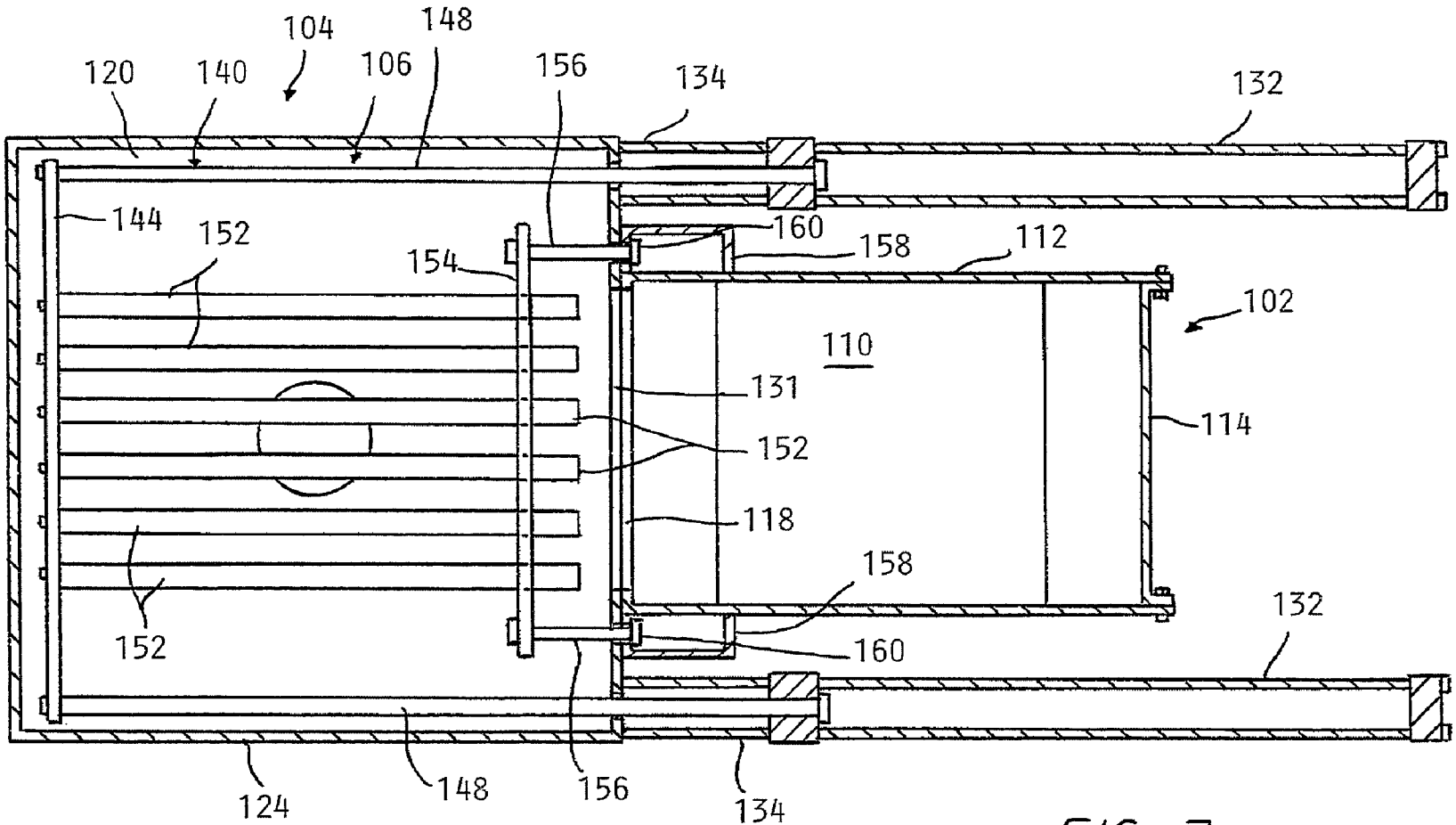
FIG. 7 is a top, cutaway view of the tramp metal separation device showing the upper drawer of the magnet assembly in a retracted position, and omitting the lower drawer of the magnet assembly for clarity.
Figure 8:
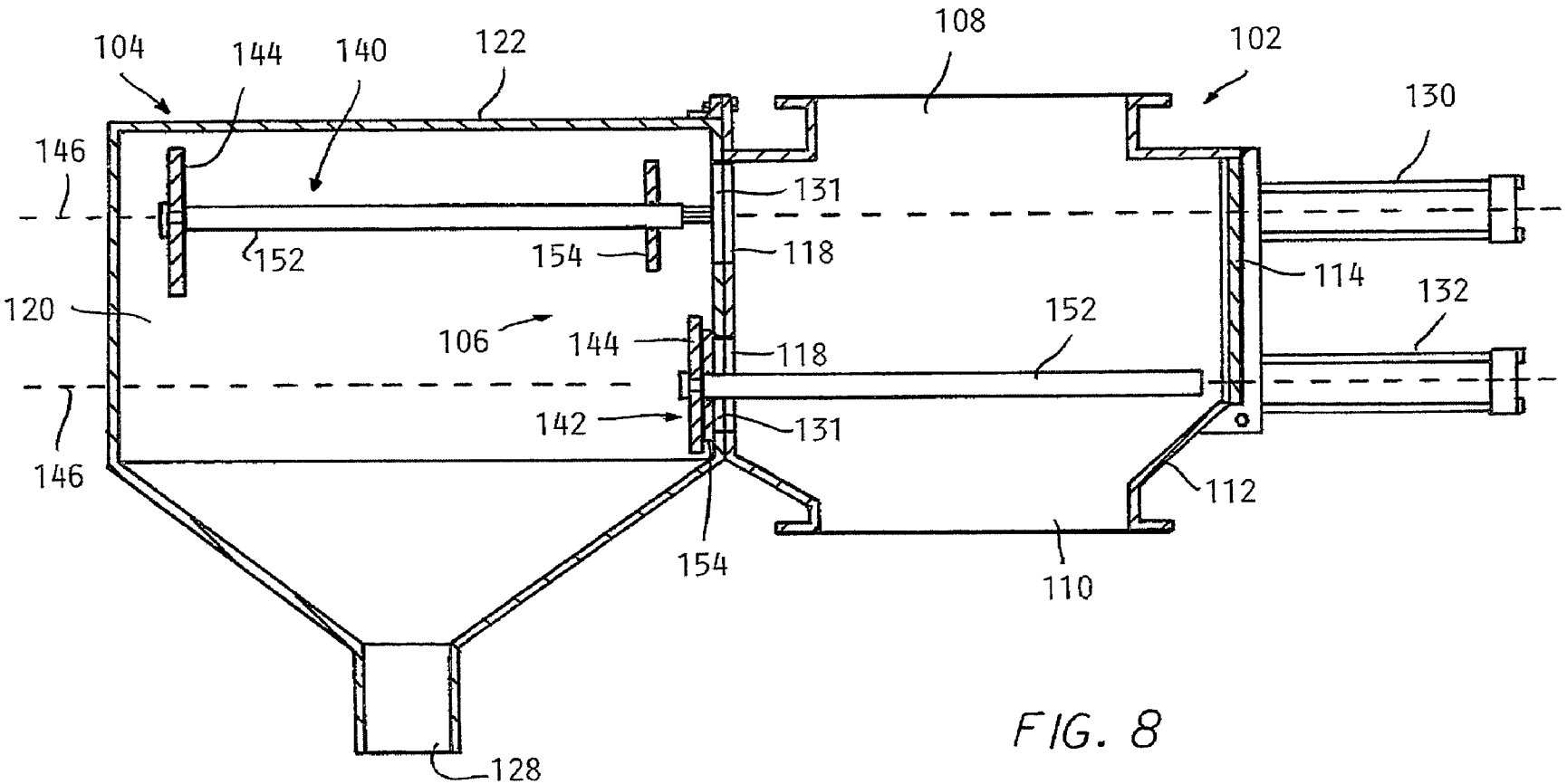
FIG. 8 is a side, cutaway view of the tramp metal separation device showing the upper drawer of the magnet assembly in a retracted position and the lower drawer of a magnet assembly in the extended position.

FIGS. 2-4 show a continuous cleaning tramp metal separation device 100 according to the invention. The tramp metal separation device 100 includes a primary housing 102 and a secondary housing 104. The tramp metal separation device 100 also includes a magnet assembly 106. Portions of the magnet assembly 106 are selectively positionable within the primary housing, for removing metallic contaminants from a stream of raw materials (not shown) that is passing through the primary housing 102, and the secondary housing 104, where metallic contaminants are removed from the magnetic assembly 106, as will be described further herein.

The primary housing 102 is typically fabricated as a thin-walled metallic structure, although it should be understood that other materials could be utilized. The primary housing 102 is adapted to receive a flow of raw material at an inlet 108. As shown in the illustrated embodiment, the inlet 108 may be a large, square or rectangular opening that is positioned at the top of the primary housing 106. However, it should be understood that the inlet 108 is not committed to this position or geometry. The raw material is discharged from the primary housing at an outlet 110, which is typically positioned opposite the inlet 108. In the illustrated embodiment, the outlet 110 is a large, square or rectangular opening that is positioned at the bottom of the primary housing 102. However, it should be understood that the outlet 110 could be provided having other shapes or positions.

In order to prevent large contaminants from entering the primary housing 102, a series of bars 109 may be positioned across the inlet 108 at spacings suitable for preventing the undesirable large contaminants from entering the primary housing 102. It should be understood that other structures could be provided for this purpose in lieu of the bars 109, such as grating or screens.

Between the inlet 108 and the outlet 110, the primary housing 102 is defined by a peripheral wall 112 that spaces the inlet 108 from the outlet 110. In order to allow access into the interior of the primary housing 102, a door 114 may be provided along the peripheral wall 112. A mechanical latch 116 may be provided for selectively locking the door 114 in a closed position with respect to the peripheral wall 112 of the primary housing 102.

Opposite the door 114, one or more openings are provided in the peripheral wall 112 of the primary housing 102 adjacent to the secondary housing 104. The openings 118 are adapted to allow movement of at least a portion of the magnet assembly 106 between the primary housing 102 and the secondary housing 104.

The secondary housing 104 defines an enclosed interior 120 into which at least a portion of the magnet assembly 106 may be received for cleaning purposes. The secondary housing 104 is defined by a substantially continuous and uninterrupted top surface 122, a peripheral wall 124, a substantially conical or pyramidal funnel portion 126 opposite the top surface 122, and an outlet tube 128 at a base of the funnel portion 126 and opposite the top surface 122. One or more openings 131 are formed through the peripheral wall 124 of the secondary housing 104 adjacent to the primary housing 102 to allow movement of at least a portion of the magnet assembly 106 into the secondary housing 104 for the purpose of cleaning the magnet assembly 106. As will be explained further herein, when the magnet assembly 106 is moved into the secondary housing 104, metallic contaminants are removed from the magnet assembly 106 and are directed out of the enclosed interior 120 of the secondary housing 104 through the outlet tube 128.

To facilitate movement of the magnet assembly 106, as will be explained in detail herein, a plurality of actuators are provided such as an upper pair of linear actuators 130 and a lower pair of linear actuators 132. A bearing housing 134 having a plurality of bearings 136 disposed therein may be associated with each of the linear actuators 130, 132 for providing additional control of the motion of the magnet assembly 106. It should be understood that the linear actuators 130, 132 could be any now known or later-developed linear actuators, such as electrical, pneumatic, or hydraulic linear actuators. It should also be recognized that devices such as ball screws, lead screws, and gear racks could be provided to drive the linear actuators 130, 132 using a rotational input.

The tramp metal separation device 100 may also include a control box 138 that controls motion of the linear actuators 130, 132. The control box 138 typically includes a programmable controller having a central processing unit, ROM, RAM, and various inputs and outputs as is well known in the art.

The magnet assembly 106 will now be explained with reference to FIGS. 5-8. In the illustrated embodiment, the magnet assembly 106 includes an upper drawer 140 and a lower drawer 142. However, it should be understood that additional drawers could be provided as part of the magnet assembly 106, as long as the magnet assembly 106 has at least two drawers.

The upper drawer 140 and the lower drawer 142 are identical in construction. Accordingly, the upper drawer 140 and the lower drawer 142 will be described herein with reference to the upper drawer 140, as representative of both the upper drawer 140 and the lower drawer 142.

The upper drawer 140 includes a face plate 144 that is slidably mounted within the secondary housing 104 for movement along an extension axis 146 between an extended position (and retracted positions. In a typical tramp metal separation device 100, as illustrated herein, the extension axis 146 may be substantially horizontal. However, other orientations may be provided as well.

The face plate 144 of the upper drawer 140 is slidably supported by a pair of extension rods 148. The extension rods 148 are securely connected to the face plate 144 in a rigid manner, such as using mechanical securement including bolts or other suitable fasteners. The extension rods 148 are the primary support structures for the upper drawer 140 and thus are sufficiently strong to support such a loading.

The extension rods 148 are at least partially disposed within the lower pair of linear actuators 132, which move the extension rods 148 and the face plate 144 of the upper drawer 140 between extended and retracted positions. A mechanical stop 150 may be provided on each of the extension rods 148 within the interior of a respective one of the lower pair of linear actuators in order to prevent overextension and accidental dislodgment of the extension rods 148 from the lower pair of linear actuators 132.

In order to remove metallic contaminants from the stream of raw materials that is passing through the primary housing 102, a plurality of magnets 152 are connected to the face plate 144 of the upper drawer 140. The magnets 152 are elongate, such that each magnet 152 extends across a majority of the width of the primary housing 102 when disposed therein. Typically, the magnets 152 are cylindrical in shape. The magnets 152 are strong magnets, and most typically are rare earth magnets, such that the magnetic force produced by the magnets 152 is sufficient to remove contaminants from the stream of raw materials. Optionally, the magnets 152 may be comprised of a stainless steel tube that covers and encloses a solid core of magnetic material.

The magnets 152 may be connected to the face plate 144 in a cantilever fashion using mechanical securement such as bolts or similar fasteners. The magnets 152 extend from the face plate 144 such that the majority of each magnet 152 may be disposed within the primary housing 102 during operation of the tramp metal separation device 100. In the illustrated embodiment, six magnets 152 are provided. However, it should be understood that the number of magnets may be varied according to the requirements of a particular application.

The upper drawer 140 further includes a wiper plate 154 that is disposed within the secondary housing 104 between the face plate 144 and the peripheral wall 124 of the secondary housing 104. As will be described further herein, each of the magnets 152 extends through the wiper plate 154. Furthermore, as with the face plate 144, the wiper plate 154 also moves toward extended and retracted positions along the extension axis 146. However, the range of motion of the wiper plate 154 is far shorter than that of the face plate 144 to allow the magnets 152 to move with respect to the wiper plate 154 such that at least a majority of the length of each of the magnets 152 slides through the wiper plate 154 to allow cleaning of the magnets 152 within the secondary housing 104, as will also be explained herein.

The wiper plate 154 is supported for sliding movement within the secondary housing 104 on extension rods 156. The extension rods 156 are rigidly secured to the wiper plate 154, and each extends into and is retained by a rod housing 158. The rod housings 158 are positioned on opposite sides of the secondary housing 104. Mechanical stops 160, such as shoulders or projections, are provided on the extension rods 156 to prevent overextension of the extension rods 156 out of the rod housings 158.

Figure 9:
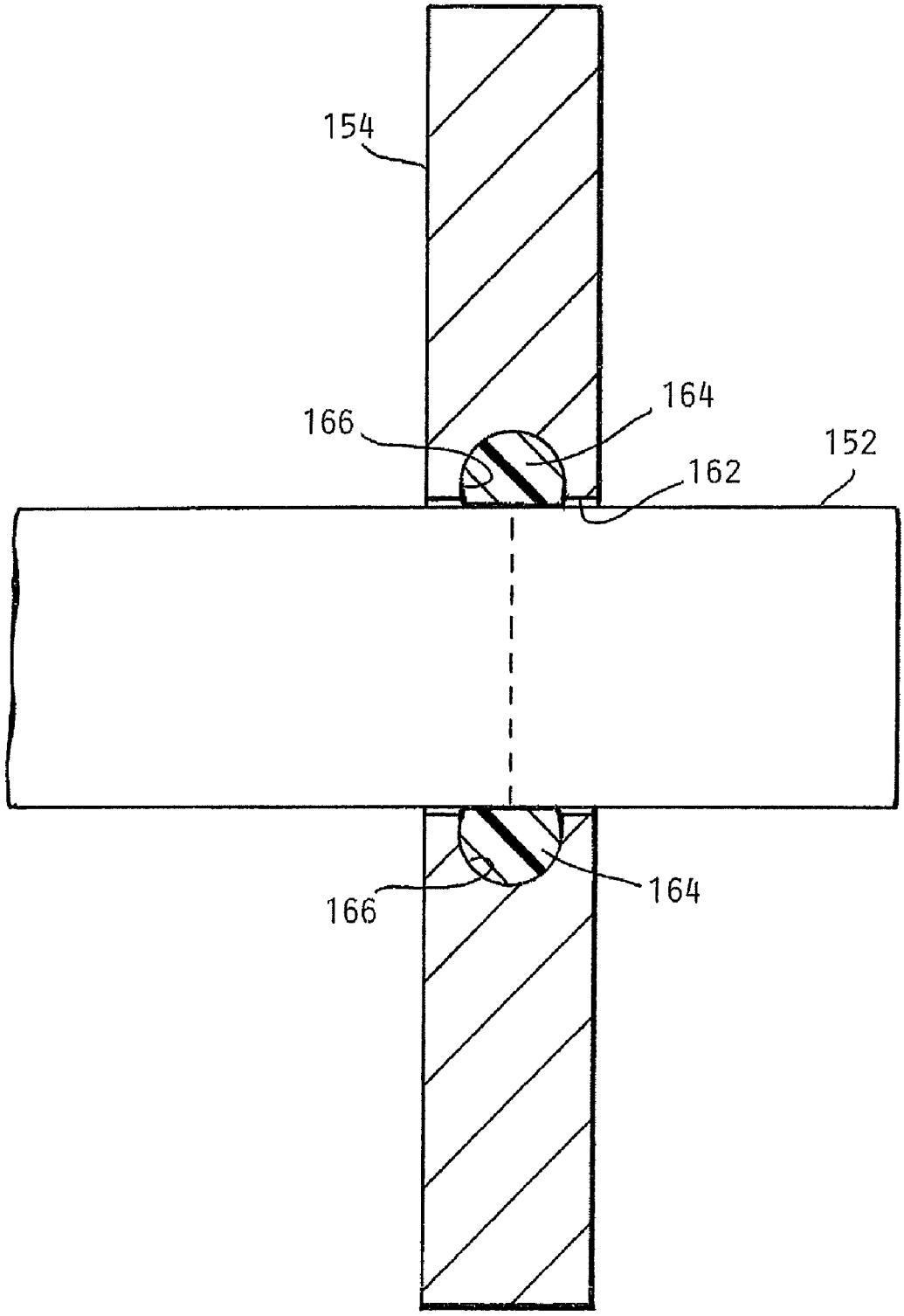
FIG. 9 is a detail showing a portion of the upper drawer of the magnet assembly including a wiper plate and a magnet.

To allow cleaning of the magnets 152 by the wiper plate 154, each magnet 152 extends through a respective bore 162 that is formed through the wiper plate 154, as shown in FIG. 9. The bores 162 are complementary in shape to the magnets 152, and thus may be cylindrical in shape.

Within each bore 162, a wiper element 164, such as an o-ring, is seated within a groove 166 that is formed along the bore 162. Thus, as the magnets 152 move with respect to the wiper plate 154 through the bores 162 in the wiper plate 154, the ferromagnetic contaminants on the magnets 152 are wiped by the wiper elements 164 and fall away from the magnets 152 and into the enclosed interior 120 of the secondary housing 104.

With further reference to FIGS. 5-8, and in light of the foregoing description, it will be appreciated that each of the upper drawer 140 and the lower drawer 142 move between extended and retracted positions. In their extended positions, the magnets 152 of the upper drawer 140 and the lower drawer 142 are disposed within the primary housing 102 and thus are positioned within the stream of raw materials. In their retracted positions, the magnets 152 of the upper drawer 140 and the lower drawer 142 are positioned within the secondary housing 104 in order to move ferromagnetic contaminants from the magnets 152.

The wiper plates 154 move in correspondence with the face plates 144 as the upper and lower drawers 140, 142 move between their extended and retracted positions. In particular, the wiper plate 154 is positioned adjacent to or in the openings 131 through the peripheral wall 124 of the secondary housing 104 when the wiper plate 154 is in its idle position and the upper and lower drawers 140, 142 are in their extended positions, thus capturing the wiper plate 154 between the face plate 144 of a respective one of the upper drawer 140 and the lower drawer 142 and the peripheral wall 124 of the secondary housing 104. In the cleaning position, the wiper plate 144 of each of the upper drawer 140 and the lower drawer 142 is spaced from the peripheral wall 124 of the secondary housing 104 at a relatively short distance therefrom, such that a majority of the length of each of the magnets 152 is disposed between the face plate 144 and the wiper plate 154 of each of the upper and lower drawers 140, 142. Movement of the wiper plates 154 may be accomplished by frictional engagement of the o-rings 164 with each of the magnets 152, thereby moving the wiper plate 154 simultaneously with the face plate 154 until the extension rods 156 that are attached to and supporting the wiper plate 144 are restrained from further movement by engagement of the mechanical stops 160 within the rod housing 158. Alternatively, separate actuators (not shown) could be provided to facilitate movement of the wiper plates 154 between the idle position and the cleaning position.

To ensure that at least one of the upper and lower drawers 140, 142 remains in the extended position when the other of the upper and lower drawers 140, 142 is in the retracted position, each of the upper drawer 140 and the lower drawer 142 is restrained against movement from the extended position to the retracted position when the other of the upper drawer 140 and the lower drawer 142 is disposed in the retracted position.

In order to do this, the control box 138 may be operable to prevent simultaneous retraction of both of the upper and lower drawers 140, 142, by providing a blocking signal to prevent simultaneous retraction of the upper and lower drawers 140, 142, or by actuating an electrically-controlled interlock (not shown). Alternatively, a mechanical interlock (not shown) may be utilized. Preventing simultaneous removal of both of the upper and lower drawers 140, 142 allows continuous operation of the tramp metal separation device 100, by ensuring that at least one of the upper drawer 140 or the lower drawer 142 remains positioned in the stream of raw materials at all times. Furthermore, because the upper and lower drawers 140, 142 are retracted into the secondary housing 104, which is substantially enclosed, the cleaning operation described herein may be performed without introducing contaminants into the primary housing 102 during the cleaning operation.

In typical operation, a time sequence is initiated through the control box 138 of the tramp metal separation device 100. In this sequence, the upper and lower drawers 140, 142 are positioned in the product stream within the conduit for a predetermined time interval T1. Upon the expiration of T1, the control box 138 instructs the upper drawer 140 to move from its extended to its retracted position within the secondary housing 102. As the upper drawer 18 is moved to its retracted position, the wiper elements 164 wipe the magnets 152 clean of accumulated ferromagnetic contaminants. As soon as this cleaning operation has been completed, the upper drawer 140 is then moved to its extended position, marking the beginning of time interval T2. At the expiration of time interval T2, the lower drawer 142 is moved from its extended to its retracted position within the secondary housing 104, and a cleaning operation identical to that performed on magnets 152 of upper drawer 140 is initiated. As soon as the magnets 152 of the lower drawer 142 are wiped clean of their contaminants, the lower drawer 142 is then returned to its extended position, at which time both the upper drawer 140 and the lower drawer 142 are in the extended position.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A tramp metal separation device for removing contaminants from a stream of raw materials, the tramp metal separation device comprising:

a first housing having an inlet and an outlet;

a first drawer having a plurality of magnets and a wiper assembly, where the first drawer is supported with respect to the first housing such that the first drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the first drawer moves from the extended position to the retracted position; and a second drawer having a plurality of magnets and a wiper assembly, where the second drawer is supported with respect to the first housing such that the second drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the second drawer moves from the extended position to the retracted position; and a second housing that is connected to the first housing, the second housing having a substantially enclosed interior, wherein the magnets of the first drawer and the second drawer are positioned within the second housing when the first drawer and the second drawer are in their respective retracted positions.

2. A tramp metal separation device for removing contaminants from a stream of raw materials, the tramp metal separation device comprising:

a first housing having an inlet and an outlet;

a first drawer having a plurality of magnets and a wiper assembly, where the first drawer is supported with respect to the first housing such that the first drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the first drawer moves from the extended position to the retracted position;

a second drawer having a plurality of magnets and a wiper assembly, where the second drawer is supported with respect to the first housing such that the second drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the second drawer moves from the extended position to the retracted position; and a second housing that is connected to the first housing, the second housing having a substantially enclosed interior and an outlet for removing contaminants from the second housing, wherein the magnets of the first drawer and the second drawer are positioned within the second housing when the first drawer and the second drawer are in their respective retracted positions.

3. The tramp metal separation device of claim 1, further comprising:

a controller operable to control movement of each of the first drawer and the second drawer, wherein the controller is operable to prevent simultaneous disposition of both of the first drawer and the second drawer to the retracted position.

4. The tramp metal separation device of claim 1, further comprising:

a first actuator operatively connected to the first drawer and electrically connected to the controller for moving the first drawer between its extended position and its retracted position in response to signals from the controller; and a second actuator operatively connected to the second drawer and electrically connected to the controller for moving the second drawer between its extended position and its retracted position in response to signals from the controller.

5. A tramp metal separation device for removing contaminants from a stream of raw materials, the tramp metal separation device comprising:

a first housing having an inlet and an outlet;

a first drawer having a plurality of magnets and a wiper assembly, where the first drawer is supported with respect to the first housing such that the first drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the first drawer moves from the extended position to the retracted position;

a second drawer having a plurality of magnets and a wiper assembly, where the second drawer is supported with respect to the first housing such that the second drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the second drawer moves from the extended position to the retracted position; and the wiper assembly of each of the first drawer and the second drawer having a wiper plate to remove contaminants from each of the first drawer and the second drawer, respectively, wherein each wiper plate is spaced with respect to a peripheral wall of a second housing and is disposed within the second housing when the respective one of the first drawer or the second drawer is positioned in the retracted position.

6. The tramp metal separation device of claim 1, wherein the first drawer and the second drawer are arranged in a vertically-spaced configuration with respect to one another.

7. The tramp metal separation device of claim 1, further comprising:

the wiper assembly of each of the first drawer and the second drawer having a plurality of bores formed therethrough, each bore having a respective magnet extending therethrough, wherein each bore has a wiper element disposed therein for removing contaminants from the magnets.

8. The tramp metal separation device of claim 7, wherein each wiper element is an o-ring.

9. A tramp metal separation device for removing contaminants from a stream of raw materials, the tramp metal separation device comprising:

a first housing having an inlet and an outlet;

a first drawer having a plurality of magnets and a wiper assembly, where the first drawer is supported with respect to the first housing such that the first drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the first drawer moves from the extended position to the retracted position;

a second drawer having a plurality of magnets and a wiper assembly, where the second drawer is supported with respect to the first housing such that the second drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the second drawer moves from the extended position to the retracted position;

a second housing that is connected to the first housing, the second housing having a substantially enclosed interior and an outlet for removing contaminants from the second housing, wherein the magnets of the first drawer and the second drawer are positioned within the second housing when the first drawer and the second drawer are in their respective retracted positions; and a controller operable to control movement of each of the first drawer and the second drawer, wherein the controller is operable to prevent simultaneous disposition of both of the first drawer and the second drawer in the retracted position, such that each of the first drawer and the second drawer is restrained against movement from the extended position to the retracted position when the other of the first drawer and the second drawer is disposed in the retracted position.

10. The tramp metal separation device of claim 9, further comprising:

a first actuator operatively connected to the first drawer and electrically connected to the controller for moving the first drawer between its extended position and its retracted position in response to signals from the controller; and a second actuator operatively connected to the second drawer and electrically connected to the controller for moving the second drawer between its extended position and its retracted position in response to signals from the controller.

11. The tramp metal separation device of claim 9, wherein the first drawer and the second drawer are arranged in a vertically-spaced configuration with respect to one another.

12. The tramp metal separation device of claim 9, further comprising:

the wiper assembly of each of the first drawer and the second drawer having a wiper plate to remove contaminants from each of the first drawer and the second drawer, respectively, wherein each wiper plate is spaced with respect to a peripheral wall of the second housing and is disposed within the second housing when the respective one of the first drawer or the second drawer is positioned in the retracted position.

13. The tramp metal separation device of claim 12, further comprising:

the wiper assembly of each of the first drawer and the second drawer having a plurality of bores formed therethrough, each bore having a respective magnet extending therethrough, wherein each bore has a wiper element disposed therein for removing contaminants from the magnets.

14. The tramp metal separation device of claim 13, wherein each wiper element is an o-ring.

15. A tramp metal separation device for removing contaminants from a stream of raw materials, the tramp metal separation device comprising:

a first housing having an inlet and an outlet;

a first drawer having a plurality of magnets and a wiper assembly, where the first drawer is supported with respect to the first housing such that the first drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the first drawer moves from the extended position to the retracted position;

a second drawer that is arranged in a vertically spaced relationship with the first drawer and below the first drawer, the second drawer having a plurality of magnets and a wiper assembly, where the second drawer is supported with respect to the first housing such that the second drawer is moveable between an extended position, wherein the magnets are positioned within the first housing and are adapted to be in contact with the stream of raw materials, and a retracted position, wherein the magnets are positioned outside of the first housing and further wherein the wiper assembly removes contaminants from the magnets as the second drawer moves from the extended position to the retracted position; and a second housing that is connected to the first housing, the second housing having a substantially enclosed interior and an outlet for removing contaminants from the second housing, wherein the magnets of the first drawer and the second drawer are positioned within the second housing when the first drawer and the second drawer are in their respective retracted positions;

a controller operable to control movement of each of the first drawer and the second drawer, wherein the controller is operable to prevent simultaneous disposition of both of the first drawer and the second drawer in the retracted position, such that each of the first drawer and the second drawer is restrained against movement from the extended position to the retracted position when the other of the first drawer and the second drawer is disposed in the retracted position;

a first actuator operatively connected to the first drawer and electrically connected to the controller for moving the first drawer between its extended position and its retracted position in response to signals from the controller; and a second actuator operatively connected to the second drawer and electrically connected to the controller for moving the second drawer between its extended position and its retracted position in response to signals from the controller.

16. The tramp metal separation device of claim 15, further comprising:

the wiper assembly of each of the first drawer and the second drawer having a wiper plate to remove contaminants from each of the first drawer and the second drawer, respectively, wherein each wiper plate is spaced with respect to a peripheral wall of the second housing and is disposed within the second housing when the respective one of the first drawer or the second drawer is positioned in the retracted position.

17. The tramp metal separation device of claim 16, further comprising:

the wiper assembly of each of the first drawer and the second drawer having a plurality of bores formed therethrough, each bore having a respective magnet extending therethrough, wherein each bore has a wiper element disposed therein for removing contaminants from the magnets.

18. The tramp metal separation device of claim 17, wherein each wiper element is an o-ring.

* * * * *